US007866073B2

(12) United States Patent
Dunlap et al.

(10) Patent No.: US 7,866,073 B2
(45) Date of Patent: Jan. 11, 2011

(54) PLASTIC CONTAINERS WITH MICRO-OPTIC IDENTIFICATION

(75) Inventors: Richard L. Dunlap, Cairo, OH (US); William A. Slat, Brooklyn, MI (US)

(73) Assignee: Plastipak Packaging, Inc., Plymouth, MI (US)

( * ) Notice: Subject to any disclaimer, the term of this patent is extended or adjusted under 35 U.S.C. 154(b) by 1449 days.

(21) Appl. No.: 11/286,895

(22) Filed: Nov. 23, 2005

(65) Prior Publication Data

US 2006/0181777 A1 Aug. 17, 2006

Related U.S. Application Data

(60) Provisional application No. 60/653,077, filed on Feb. 15, 2005.

(51) Int. Cl.
*G09F 3/00* (2006.01)

(52) U.S. Cl. ..... 40/310; 359/619; 40/454

(58) Field of Classification Search ..... 40/310, 40/638, 454; 359/619, 926
See application file for complete search history.

(56) References Cited

U.S. PATENT DOCUMENTS

| | | | | |
|---|---|---|---|---|
| 6,781,761 | B2 | 8/2004 | Raymond | |
| 7,333,268 | B2 * | 2/2008 | Steenblik et al. | 359/619 |
| 2005/0180020 | A1 * | 8/2005 | Steenblik et al. | 359/626 |
| 2007/0291362 | A1 * | 12/2007 | Hill et al. | 359/567 |
| 2008/0259416 | A1 * | 10/2008 | Peters et al. | 359/2 |
| 2008/0284157 | A1 * | 11/2008 | Muke et al. | 283/86 |

* cited by examiner

*Primary Examiner*—Cassandra Davis
(74) *Attorney, Agent, or Firm*—Dykema Gossett PLLC

(57) ABSTRACT

A plastic container with the sidewall thereof including a label panel and a label adhered to the label panel. The label includes micro-optics as at least part of the label to create an image of depth in the micro-optic area.

20 Claims, 2 Drawing Sheets

PLASTIC CONTAINERS WITH MICRO-OPTIC IDENTIFICATION

CROSS-REFERENCE TO RELATED APPLICATIONS

This application is based on provisional U.S. Patent Application Ser. No. 60/653,077, filed Feb. 15, 2005.

BACKGROUND OF THE INVENTION

In the past efforts have been made to obtain three dimensional imaging (3D) on a plastic container.

One such method is to create a raised area on the container using a word or logo. This method gives product or brand identity. However, this method does not permit a change to be made without a major cost. For example, in order to obtain a blow molded container by this method one would require the mold to have the desired word or logo embossed in the mold, requiring additional metal to be removed during the mold making process. Also, each container made with that mold would have the same word or logo thereon, eliminating the opportunity of using that mold for multiple customers or products.

Another method used to create a three dimensional effect is to again create a raised area on the container and then try to register a label to the raised area to give a 3D appearance. This has proven to be extremely difficult to do and in some cases quite costly. Moreover, this procedure requires the label to be placed in perfect register with the raised area of the container, which is also difficult to do.

An alternative to a raised area in a container is an embossed area in a container. Here again, that is a decision that must be made in advance and would require alteration of the mold. Moreover, registering a label over an embossed area is not only difficult but generally would cause undesirable wrinkling in the label.

A further way of creating a 3D appearance is to put a release coating on the rear of the label to prevent certain areas of the label from adhering to the container, thus allowing the label to lift in certain areas. One of the major problems with this procedure is that items can rub or catch on the raised area and tear the raised area, causing the label to be defaced.

Embossing a label during printing is another option that has been used. However, handling the embossed label for application is difficult and this procedure cannot be used on all types of labeling or labeling equipment. An example of a labeling process where embossed labels are not used is in-mold labeling. During this molding process the pressure needed to blow the container eliminates the embossing in the label.

Holographic labels also give a dimensional appearance, but have limitations. A big limitation is in handling of a holographic label, not only during application but also during storage. A holographic label is extremely susceptible to atmospheric conditions creating curl and making them difficult to apply.

Lenticular labeling in recent years has been a method of choice, for example, on round container applications during injection molding, see U.S. Pat. No. 6,781,761. This method has worked successfully on injection molded containers, but not on blow molded containers. The thickness of the lenticular label is a problem in the blow molding process. Because of the thickness of the label the formation of the plastic around the label in the blowing process creates a weak area around the label causing container failure; whereas, an injection mold can be designed to accommodate the thickness need in a given area so as to accommodate the lenticular label. Moreover, containers with lenticular systems are primarily injection molded, round containers with the lenticular label wrapped completely around the container. If the lenticular system is applied as a spot label, for example, on a blow molded container, the container will become weak around the edges of the lenticular label creating an area for container failure. In addition, the lenticular process requires the total label to be covered lenticular. If the entire label is not lenticular, dispensing and handling issues occur. The thickness of the lenticular area is so great that it does not allow the non-lenticular area to be adjusted to the same thickness as the lenticular area.

It would be highly desirable to provide a container incorporating micro-optics for 3D label imaging and anti-counterfeiting. Micro-optics provides a much thinner finished material that makes it compatible for blow molding as well as creating an image of depth in a given area that can incorporate a given design, logo, pattern or picture.

Accordingly, it is an object of the present invention to provide a plastic container incorporating micro-optics in a 3D label, particularly a blow molded plastic container.

Further objects and advantages of the present invention will appear hereinbelow.

SUMMARY OF THE PRESENT INVENTION

In accordance with the present invention the foregoing objects and advantages are obtained.

The improved container of the present invention comprises: a plastic container, particularly a blow molded plastic container, having a base and a sidewall projecting upwardly from the base, a neck finish projecting upwardly from the sidewall and having an opening to the inside of the container, wherein the sidewall includes a label panel, as a substantially flat label panel; and a label adhered to the label panel, with micro-optics included as at least part of the label to create an image of depth in the micro-optic area. The aforesaid micro-optic plastic container could have an in-mold label, a pressure sensitive label or a glue applied label.

The micro-optic label creates a three dimensional (3D) image which is an effective way of communicating a message. Thus, for example, the 3D imaging offers the advantage of presenting a message in a number of different ways. Illustrative of this, a message can be conveyed as a picture that gives the appearance of looking through a window, or it can present an image or logo inside the spelling of a brand name of a product, or a combination of these.

The micro-optic container of the present invention can be a round or non-round container and is preferably a blow molded plastic container.

Further features and advantages of the present invention will appear hereinbelow.

BRIEF DESCRIPTION OF THE DRAWINGS

The present invention will be more readily understandable from a consideration of the following, illustrative drawings, wherein.

DETAILED DESCRIPTION OF PREFERRED EMBODIMENTS

Figure 2:
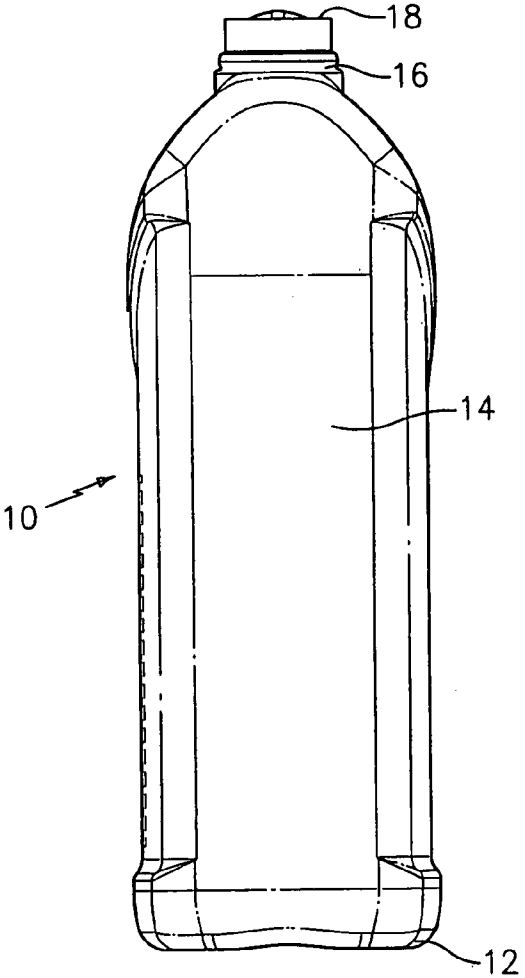
FIG. 2 is a front view of the container of FIG. 1.
Figure 1:
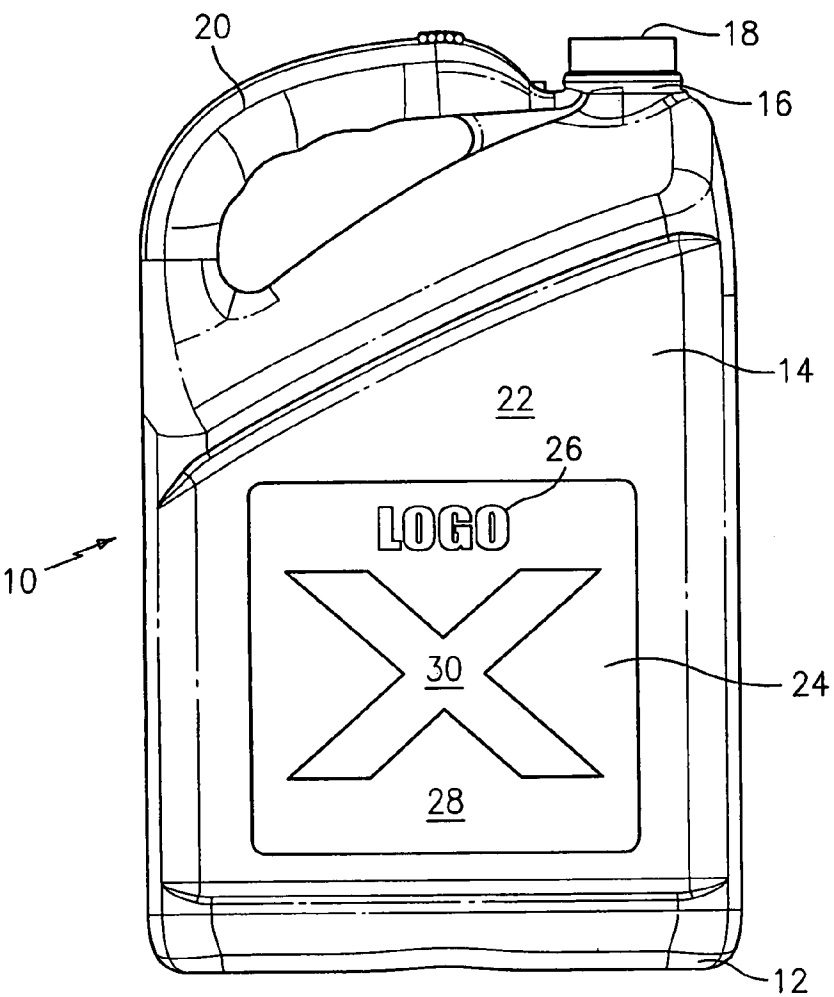
FIG. 1 is a side view of one embodiment of the container of the present invention with micro-optic label attached.

Referring to the drawings, FIGS. 1 and 2 show one embodiment of the container of the present invention, a plastic container 10 which is a blow molded container having an annular or oval base 12, a sidewall 14 extending upwardly from base 12, a neck finish 16 extending upwardly from the sidewall 14 and having an opening 18 to the inside of the container which is closed by a suitable closure (not shown). The container 10 of this embodiment is also provided with an integral handle 20. The particular configuration of the container is not critical. Thus, for example, the container can be round, square or oval, with or without an integral handle or a separately attached handle.

Figure 3:
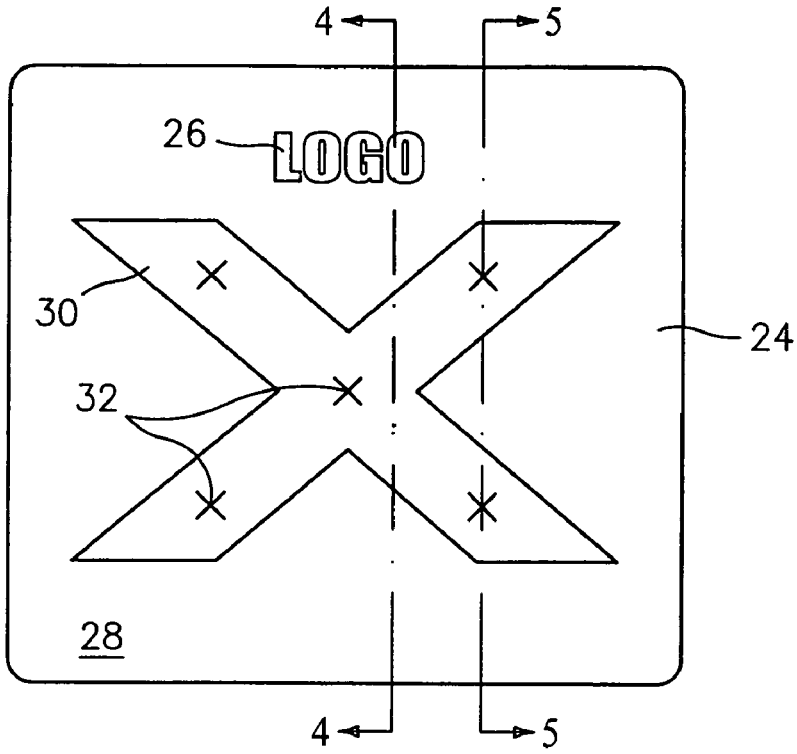
FIG. 3 is a front view of the label applied to the container of FIG. 1.
Figure 4:
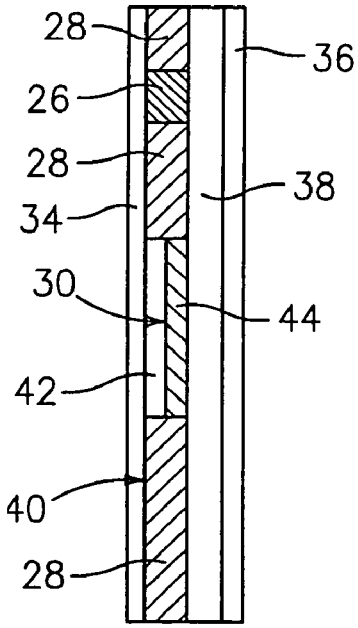
FIG. 4 is a sectional view along line 4-4 of FIG. 3.
Figure 5:
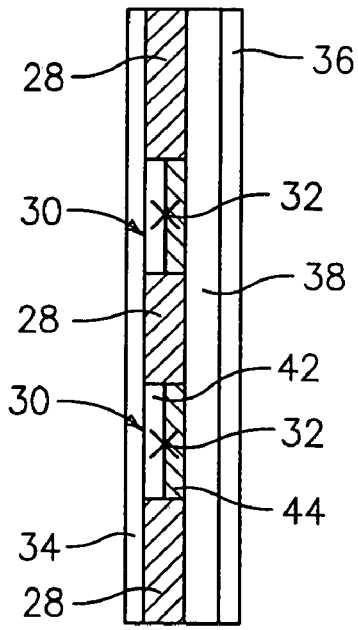
FIG. 5 is a sectional view along line 5-5 of FIG. 3.

Sidewall 14 of container 10 includes a substantially flat label panel 22 for application of micro-optic label 24 thereto shown in more detail in FIGS. 3-5. The label 24 may, for example, contain micro-optics and normal printing combined. Thus, a logo 26 or product name may be printed on the label over a white or colored background 28. The micro-optics 30 is shown by the large letter "X" and may be any desired design, logo or indicia. The small letters "x" (FIGS. 3-5) are also micro-optics 32 and can be any desired designations, designs, product name, or the like to give the product label a distinct appearance.

FIG. 4 shows a cross-sectional view with the outer layer 34 comprising a protective coating, the inner layer 36 comprising an adhesive, and inner intermediate layer 38 comprising a thin substrate of paper or plastic. Outer intermediate layer 40 includes background portions 28, logo 26 or printed product name, and main micro-optic portion 30. The main micro-optic portion 30 includes an outer lens element 42 and an inner colored or design micro-optic portion 44. A further adhesive (not shown) may be positioned between inner, colored or design micro-optic portion 44 and substrate 38. The lens element is generally a polymer film which incorporates a linear array of cylindrical lenses.

FIG. 5 shows a similar cross-sectional view, except that the small micro-optic portions 32 are also shown.

Any suitable plastic material can be used for the container, such as polyethylene or polyethylene terephthalate. The label substrate should desirably be compatible with the material of the container for recycling, for example, for a polyethylene container the label substrate may conveniently be polyethylene or polypropylene. Similarly, the adhesive or adhesives should preferably be compatible for recycling. Also, the micro-optic materials should preferably be compatible for recycling. Thus, for a polyethylene container the outer lens element and inner colored or design element may desirably be polypropylene, and/or polyethylene terphthalate. These elements may desirably be polyethylene terephthalate.

The outer protective coating may be lacquer or any suitable protective coating to protect inks. The adhesive should be able to hold up under stress of blow molding and shrinkage after molding.

In-mold labeling is preferred. One starts with a smooth or balanced label without bumps or variations in thickness, places the label in the mold in a desired location, and blows the container around the label. The result is a plastic container with a smooth finish and a micro-optic label thereon in a desired location. In addition, the integral, micro-optic label adds to the integrity of the container by providing support for the sidewall.

The micro-optic container of the present invention is preferably a blow molded container with integral micro-optic label thereon and with a smooth external surface. However, the container may also be injection molded or extruded.

The present invention offers significant advantages. The micro-optic structure of the present invention provides the appearance of depth in a label and allows a three dimensional appearance to be perceived. The label is a stand alone member which can be embedded on a container in a desired location and can be applied during or after the container molding process. The three dimensional label can be placed on virtually any type of container and still have the appearance of a customized container. Moreover, the containers can be used with multiple types of products. The stand alone label permits customization of the container without the additional cost of mold modification, such as embossing. The 3D image is an effective way of communicating a message and offers the advantage of presenting a message in a variety of different ways. Thus, for example, a message can be communicated as a picture that gives the appearance of looking through a window. Alternatively, the 3D image can be used to present an image or logo inside the spelling of the brand name of a product. Moreover, the container of the present invention with 3D label can be readily prepared on a commercial scale.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container which comprises:

a hollow container having a base, a sidewall projecting upwardly from the base, a neck finish projecting upwardly from the sidewall and having an opening to the inside of the container;

wherein the sidewall includes a substantially flat label panel and a multi-layered label adhered to the label panel, with micro-optics included as at least part of the label to create an image of depth in the micro-optic area;

and further wherein the outside layer of the multi-layered label comprises a protective coating, an intermediate layer of the label is one of paper and plastic, and an inside layer of the label comprises an adhesive.

2. The container according to claim 1, wherein said label is one of an in-mold label, a pressure sensitive label, and a glue applied label.

3. The container according to claim 1, wherein said micro-optic label creates a three dimensional image in the micro-optic area.

4. The container according to claim 3, wherein said container is a blow molded plastic container.

5. The container according to claim 1, having an integral handle.

6. The container according to claim 1, wherein the label includes printing.

7. The container according to claim 1, wherein the intermediate layer of the label includes background portions and micro-optic portions.

8. The container according to claim 7, wherein said intermediate layer of the label also includes printing.

9. The container according to claim 7, wherein the micro-optic portion includes an outer lens element and an inner micro-optic portion.

10. The container according to claim 1, wherein said container is polyethylene terephthalate.

11. A plastic container comprising:

a hollow container having a base;

a sidewall projecting upwardly from the base; and a neck finish projecting upwardly from the sidewall and having an opening to the inside of the container;

wherein the sidewall includes a substantially flat label panel and a multi-layered label adhered to the label panel, with micro-optics included as at least part of the label to create an image of depth in the micro-optic area;

and further wherein an outside layer of the multi-layered label comprises a protective coating, an intermediate layer of the label includes background portions and micro-optic portions, and an inside layer of the label comprises an adhesive.

12. The container according to claim 11, wherein said label is one of an in-mold label, a pressure sensitive label, and a glue applied label.

13. The container according to claim 11, wherein said multi-layered label creates a three dimensional image in the micro-optic area.

14. The container according to claim 13, wherein said container is a blow molded plastic container.

15. The container according to claim 11, having an integral handle.

16. The container according to claim 11, wherein the label contains printing and micro-optics.

17. The container according to claim 11, wherein said intermediate layer of the label is one of paper and plastic.

18. The container according to claim 11, wherein said intermediate layer of the label also includes printing.

19. The container according to claim 11, wherein the micro-optic portion includes an outer lens element and an inner micro-optic portion.

20. The container according to claim 11, wherein said container is polyethylene terephthalate.

* * * * *